US005570595A

United States Patent [19]

Alberto

[11] Patent Number: 5,570,595

[45] Date of Patent: Nov. 5, 1996

[54] CONTINUOUS DECATIZING OF FABRICS IN AUTOCLAVE

[76] Inventor: Pietro Alberto, Strada Masserano Calaria, 70 Biella (Vercelli), Italy

[21] Appl. No.: 416,767

[22] PCT Filed: Nov. 2, 1992

[86] PCT No.: PCT/IT92/00115

§ 371 Date: Apr. 13, 1995

§ 102(e) Date: Apr. 13, 1995

[87] PCT Pub. No.: WO94/10368

PCT Pub. Date: May 1, 1994

[51] Int. Cl.[6] ..... D06B 3/10; D06B 23/18

[52] U.S. Cl. ..... 68/5 E; 34/116; 34/123; 34/242

[58] Field of Search ..... 68/5 E; 34/242, 34/116, 123

[56] References Cited

U.S. PATENT DOCUMENTS

| | | | |
|---|---|---|---|
| 1,698,818 | 1/1929 | Lorenz | 34/123 X |
| 2,834,193 | 5/1958 | Fahringer | 34/242 X |
| 3,098,260 | 7/1963 | Richeson . | |
| 3,158,507 | 11/1964 | Alexander | 34/242 X |
| 3,645,116 | 2/1972 | Peter | 68/5 E |
| 4,124,942 | 11/1978 | Ohls et al. | 34/242 X |
| 4,301,665 | 11/1981 | Lopata | 68/5 E |
| 5,301,521 | 4/1994 | Bertoldo | 68/5 E X |

FOREIGN PATENT DOCUMENTS

| | | |
|---|---|---|
| 2220029 | 9/1974 | France . |
| 2546259 | 11/1984 | France . |
| 3609858 | 9/1987 | Germany . |
| 9218679 | 10/1992 | WIPO . |

*Primary Examiner*—Philip R. Coe

*Attorney, Agent, or Firm*—Panitch, Schwarze, Jacobs & Nadel, P.C.

[57] ABSTRACT

An apparatus for autoclave continuous decatizing of fabrics, having a rotating cylinder which closes the slot through which a backing cloth and the associated fabric pass to enter and exit the autoclave is provided. A foraminous hollow member, which is adapted to reduce the percentage of oxygen existing within the autoclave (1), is located adjacent to the backing material and the fabric where the backing material and the fabric enter the autoclave. Thin plates (14) are further preferably provided, movable closer to the inside of the fabric (4) immediately before it exits from the autoclave (1), under the external control, in order to be able to possibly continue the "sandwich" pressing action which takes place along the periphery of the foraminous cylinder (2), or to have in this area a free vaporizing stretch. Furthermore, particular preferred embodiments have been described for seals (19, 20) opposite the lead-in central cylinder (5), for the side surface of the latter, as well as for the antifriction material sheets (21, 22) interposed between the cylinder and inflatable seals (19, 20), for the side surface of said cylinder (5), and for the seals (25, 26; 25', 26') at the longitudinal ends thereof.

8 Claims, 2 Drawing Sheets

4
4'
3
3'
21
5
22
13
17
18
20
19
24
16
11
12
9
11'
10
14
15
23
1
2

3
4
A
22
21
18
17
19
20
5

CONTINUOUS DECATIZING OF FABRICS IN AUTOCLAVE

This invention concerns improvements in continuous decatizing of fabrics in autoclave, and more particularly an apparatus of the type described in U.S. Pat. No. 5,430,955 (which is the U.S. equivalent to Italian Application No. MI91A001119 filed on Apr. 23, 1991) by the present Applicant, all intended for the purpose of maximum improvement of this important fabric finishing operation, while retaining the peculiar advantages of the continuous operation.

As it is already known, in the continuous decatizing operation, the worst problems are posed by the steam seals at the fabric entrance and exit from the autoclave. The patent application mentioned above was already aimed at solving the apparatus sealing problems, and this invention is solely intended to making improvements in the same area.

Another basic problem of decatizing in general is that fabric and/or felt or back cloth impregnation with air and with the oxygen contained therein tends to counteract the steam reducing action within the autoclave. Therefore, the main object of this invention is to do away as much as possible with said air negative effect, in a way particularly suitable for autoclave continuous decatizing.

The above and other objects, advantages and features of the improved apparatus according to this invention will become more apparent from the following detailed description of some preferred embodiments thereof, described herein for exemplary and non limiting purposes, referring to the attached drawings, wherein.

Figure 1:
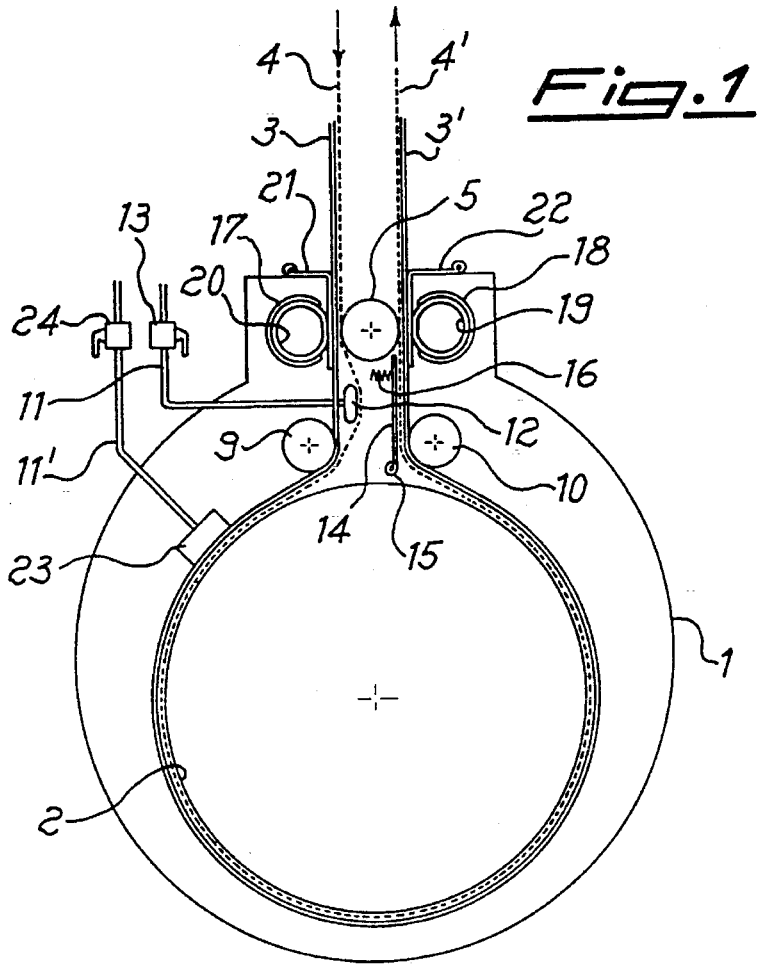
FIG. 1 shows a cross sectional view of an apparatus for continuous decatizing of fabrics in autoclave, improved according to this invention.

Referring now to the drawings, the improved apparatus according to this invention includes, as it is already known, a foraminous cylinder 2 rotatingly mounted within autoclave 1, and lined with a felt (not shown). Both a back cloth 3 preferably comprising a closed loop continuous felt, and a fabric 4 to be decatized shown in broken lines, both coming in from outside of autoclave 1, get wrapped around the cylinder. After having made an almost complete turn around the side surface of cylinder 2, the felt and the fabric exit from the autoclave again, as shown by the arrow, after passing around two guide rollers 9 and 10. Past second guide roller 10, after the felt and the fabric have left rotating cylinder 2, they are given reference numbers 3' and 4'. As described and claimed in the previous patent application mentioned above, a rotating cylinder 5 closes, as sealingly as possible, the passage between entering felt 3 and fabric 4 and felt 3' and fabric 4' being withdrawn, which are followed in their motion by said cylinder 5. At both sides of the latter there is then provided a pair of inflatable "air bag" gaskets, adapted to press felt and fabric against cylinder 5, in order to prevent any steam leakage.

According to this invention, inflatable gaskets 19 and 20 are exclusively housed within respective steel containers 17 and 18. As it was already provided in the patent application previously referred to, the friction developed by gaskets 19 and 20 against felt 3, 3' makes it advisable to interpose an antifriction material which, in the preferred embodiment of this invention, is provided by a stainless steel thin plate, 21 and 22 respectively, due to the high abrasive action of the felt used herein compared to a general "back cloth". 0f course, other rigid or semi-rigid materials may also be used, like for instance teflon, plastic and metal materials.

Further, a tubular substantially round cross sectional shape has been preferred for gaskets 19 and 20, but different shapes might be used, and non-inflatable gaskets as well, comprising for instance intrinsically resilient materials which yield in compression and provide a pushing sealing action, owing as well to their special shape, as already known for autoclave doom seals.

Figure 2:
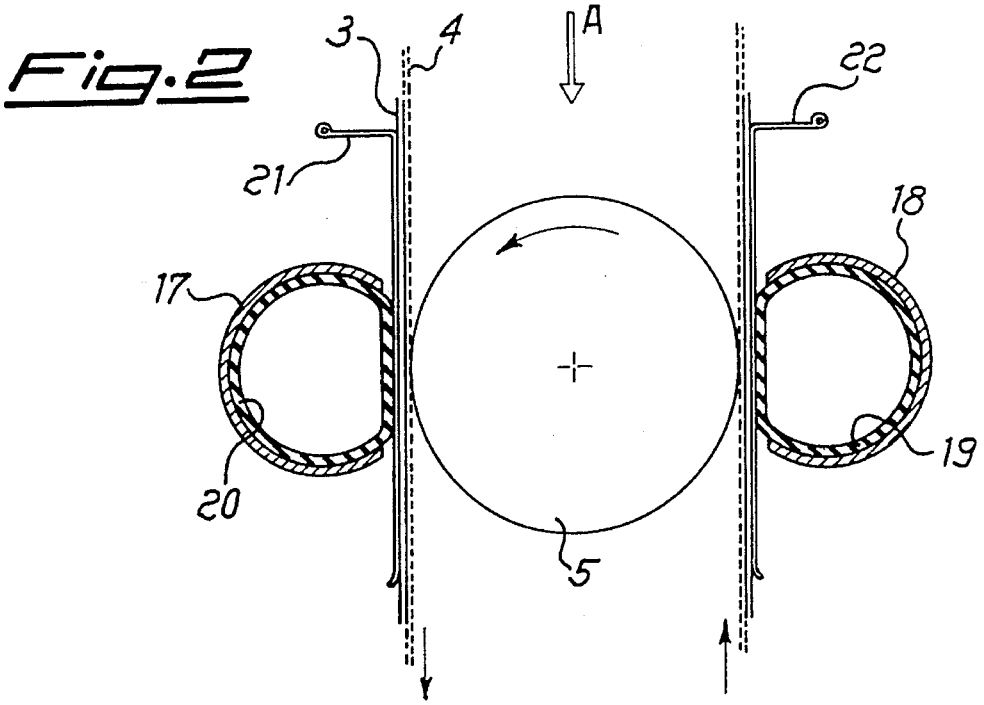
FIG. 2 shows an enlarged and more detailed view of the longitudinal steam seals, on opposite sides of the introductory cylinder.

In addition, cylinder 5 may be made perfectly smooth, as in the above patent application, or provided with a recess area in order to hold, within said peripheral recess the fabric and felt total thickness. If the cylinder is provided with a recess, thin plates 21 and 22 extend perfectly straight for the whole width of the seal (see FIG. 3), while if the cylinder were unrecess, said thin plates would have to be slightly bent at the edges thereof in order to keep planarity where the continuously fed materials thickness is missing. In FIG. 2 an unrecess cylinder 5 has been shown.

As far as the longitudinal seals are concerned, inflatable gaskets 19 and 20, housed within respective containers 17 and 18, push thin plates 21 and 22 which in turn push, from opposite directions, felt 3, 3' and fabric 4', 4' against cylinder 5.

Figure 3:
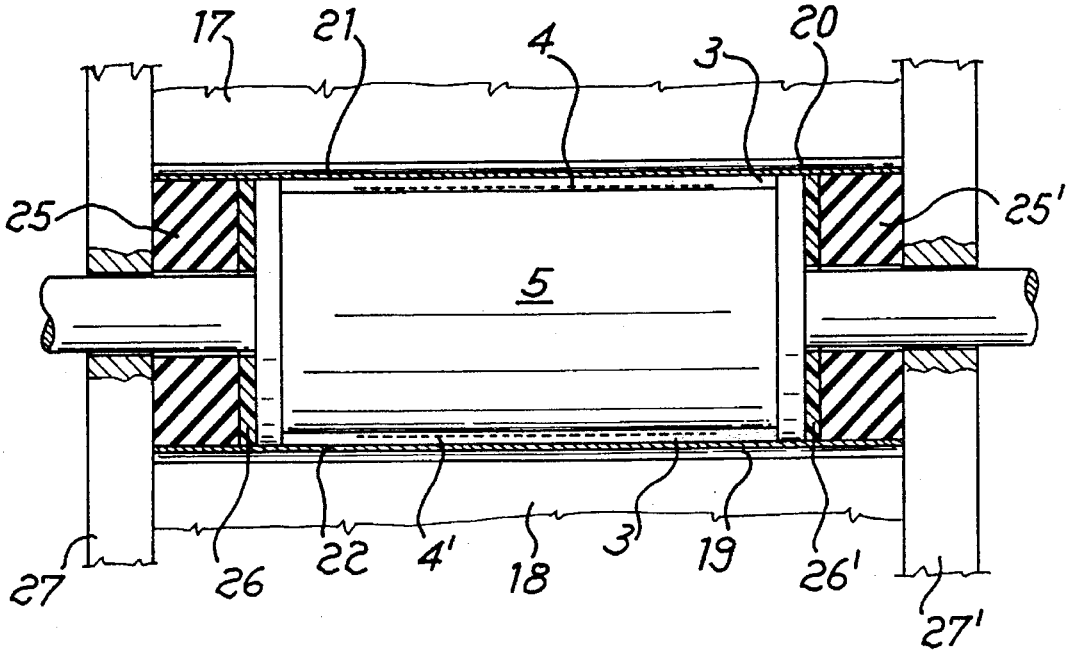
FIG. 3 is a view, taken partially along the direction of arrow A in FIG. 2, relating to the autoclave side seals.

Obviously, in order to effectively seal against steam leakages, said longitudinal seals are not enough, side seals being also required at the ends of cylinder 5, as it is shown in FIG. 3.

Unlike the previous patent application mentioned above, according to which the feeding cylinder 5 was comprised of several pieces and had resilient material ends, according to this invention the cylinder is a single piece, shorter than side supporting members 27, 2Z', and non rotatable resilient rubber gaskets 25, 25 ' are provided which are separate from cylinder 5, and are adapted to push a disc of lubricating material, like teflon 26 and 26', against the end walls of cylinder 5 respectively. Resilient gaskets 25 and 25' are mounted in a pre-compressed condition, by taking advantage of their resiliency whereby, after assembly, they can bear directly against discs 26 and 26' from side struts 27 and 27'. In such a way, a strong contact takes place between discs 26 and 26' and the rotating ends of cylinder 5. The lubrication deriving from the two discs and from condensing steam itself will provide a minimum friction engagement, thus preventing any steam leakage from the sides.

Figure 4:
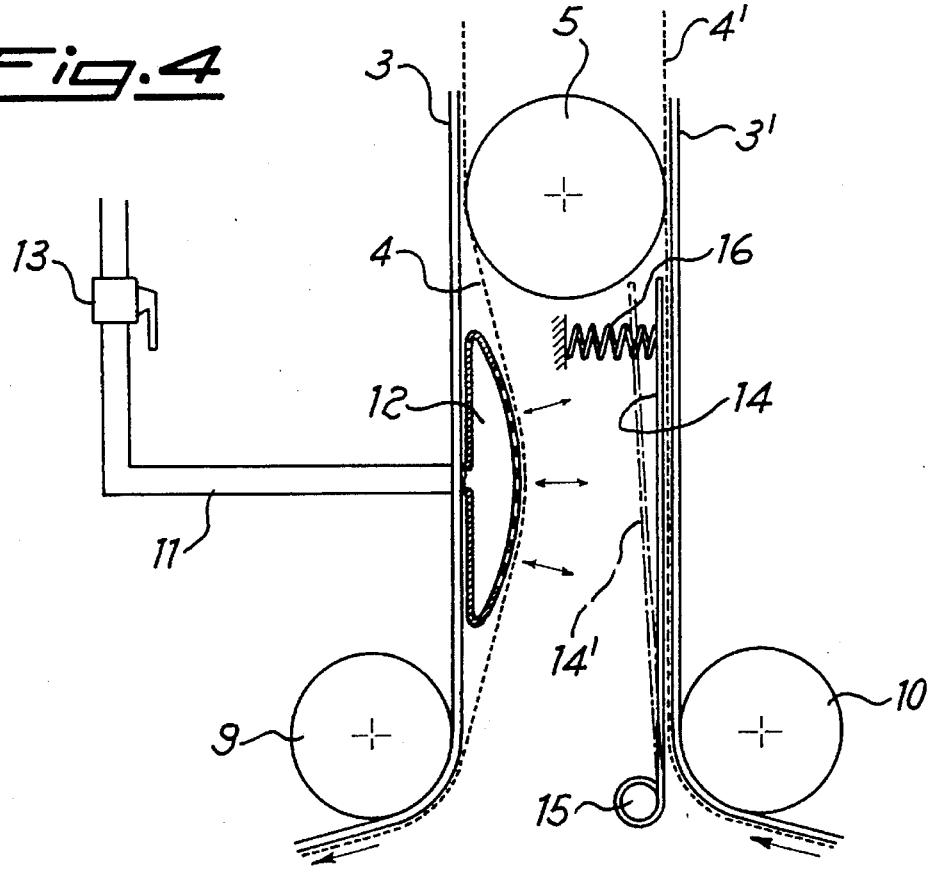
FIG. 4 shows, in an enlarged scale, a further detail of FIG. 1, within the apparatus of this invention.

More particularly, according to this invention, the apparatus includes, within the autoclave, the two special devices provided for the purpose of reducing, as already mentioned above, the action of residual oxygen introduced in the autoclave by the fabric and by the felt, together with the air they re impregnated with. Referring to FIGS. 1 and 4, a first device comprises a partially foraminous tank 12, having a length equal to the whole width of felt 3, made like a tube or a box-like fabrication of any de' Sired cross-section, but preferably/with a rounded shape as it is shown more clearly in FIG. 4, in order to avoid corners which are likely to cause wear in the fabric sliding thereon. It is arranged just in such a way that fabric 4 entering the autoclave rides on top of it getting separated from underlying felt 3. Tank 12 is connected to the outside through a line 1and by means of a valve 13. When the latter is opened, the steam pressure within autoclave 1 causes a flow of the same steam which flows across tank 12 sweeping away a substantial portion of ' the air (and therefore of the oxygen) held by the fabric, and which gets discharged and disposed of outside the steam flow. The above device is enough to dispose of the residual oxygen from the fabric when decatizing within autoclave 1 takes place from within cylinder 2 outwards. When, on the contrary, the decatizing steam flow goes from outside cylinder 2 inwards, it becomes necessary to withdraw the air from felt 3 as well, otherwise the latter would carry towards the fabric the oxygen it holds.

For said purpose, a similar device has been provided, shown as a tube-shaped or box-like fabricated tank 23, located slightly downstream of device 12, but in the first portion of the path of fabric 4, along cylinder 2. Tank 23 is connected to the outside through a tube 11' by means of a valve 24 whereby, when said valve gets opened, steam exits the autoclave through said tank openings, to get dispersed into the environment. In both cases, the same steam present within the autoclave is the means used to sweep away the air held by the fabric or felt. Air ejection is performed by means of the steam flow caused by the drop between the autoclave internal pressure and the environment.

The same results may be reached using the same devices in a different way, i.e. introducing steam into the autoclave at a higher pressure than the autoclave internal pressure. The steam flow from outside would sweep away air and oxygen contained therein from both the fabric and the felt. Therefore, in FIGS. 1 and 4, the arrows showing the steam flow have opposite directions, in oder to show the two possibile steam flow directions, coming in or going out.

A further improvement provided by this invention is based on the following considerations. Before fabric 4' and felt 3' come out from the autoclave, both materials become parted away from cylinder 2, substantially at the second guide roller 10, upon completing a substantially path before leaving said autoclave, through cylinder 5. Along this path fabric 4 is no longer subjected to the "sandwich" effect it was subjected to while moving around cylinder 2, whereby in said area the fabric remains free and since it is still inside the autoclave and in contact with steam, it is subjected to a free vaporizing action (without pressing) which involves a loss of luster. In order to prevent that, referring to FIGS. 1 and 4, a device has been provided, preferably actuated from outside, adapted to continue applying the "sandwich" effect also in the exit area.

Said device comprises a long thin plate 14, for instance stainless steel, having a length substantially equal to the distance between roller 10 and cylinder 5, pivoted at the bottom thereof at 15, and pushed by a resilient member like a spring 16 of a compressed air means, against fabric 4 '. Therefore, thin plate 14 may be brought near the fabric or it may move backwards all the way to position 14' shown in broken lines in FIG. 4 if in fact an additional free steam action after decatizing were desired.

In fact, if a very shining finishing is desired, thin plate 14 can be brought closer to the fabric so that, by pressing the fabric lightly, it would prevent steam from coming into contact with the fabric and from reducing the effects acquired through the previous decatizing, while if particular effects are desired, like a dimmer shine, a thicker fabric, and so on, it will be advisable to move said thin plate away from the fabric and to bring it to position 14' whereby the fabric, by being freely flooded by steam without being pressed, tends to swell and to loose its luster.

Obviously thin plate 14 may be moved closer or away from fabric 4' in a number of different ways known per se, and it might as well not be pivoted at 15, but controlled by two members coming closer to the fabric or apart therefrom.

I claim:

1. An improved apparatus for continuous decatizing of a fabric (4) in a pressurized steam environment comprising:

an autoclave adapted to maintain a pressurized steam environment and having a passage defined therein;

a foraminous cylinder (2) rotatably mounted within the autoclave;

first and second guide rollers (9,10) located within the autoclave;

a backing cloth (3) which supports the fabric (4) to be decatized that extends into the autoclave through the passage, between the first guide roller (9) and the foraminous cylinder (2), around the foraminous cylinder (2), between the foraminous cylinder (2) and the second guide roller (10), and out of the autoclave through the passage such that the backing cloth (3') and a decatized fabric (4') exit the autoclave, the backing cloth (3) and the fabric (4) having a predetermined width;

a rotatable cylinder (5) having ends located in the passage between a portion of the backing cloth (3) and the fabric (4) which enter into the autoclave through the passage and a portion of the backing cloth (3') and the decatized fabric (4') which exit out of the autoclave through the passage;

first and second side gaskets (19, 20) located adjacent to the rotatable cylinder (5) which cooperate with the rotatable cylinder (5) to close the passage;

an antifriction sheet (21, 22) interposed between each of the first and second side gaskets (19, 20) and the backing cloth (3, 3');

seals located at the ends of the cylinder (5); and at least one hollow member (12, 23) having a foraminous and substantially flattened surface located adjacent to and contacting at least one of the backing material (3) and the fabric (4) in a first area in proximity to where the backing material (3) and the fabric (4) enter the autoclave through the passage, the hollow member providing a path for steam flow from one of within the autoclave toward an area outside of the autoclave and from an area outside the autoclave to within the autoclave, the hollow member extending the width of at least one of the backing material (3) and the fabric (4) and being connected by a line (11, 11') to the area outside of the autoclave by a valve (13, 24).

2. The apparatus of claim 1 characterized in that the at least one hollow member (12, 23) is connected, through the line (11, 11') and the valve (13, 24) to an outer steam source, at a pressure higher than the autoclave (1) inner pressure.

3. The apparatus of claim 1, characterized in that said cylinder (5) includes a peripheral recess and, for a length at least equal to the width of the backing cloth (3) and the fabric (4), the recess has a depth which is slightly less deep than a total thickness of the backing cloth (3) and the fabric (4), whereby the the backing cloth (3) and the fabric (4) are slightly compressed between the cylinder (5) and each antifriction sheet (21, 22).

4. The apparatus of claim 1, wherein each anti-friction sheet (21, 22) comprises a thin steel plate.

5. An apparatus according to claim 1, wherein said gaskets (19, 20) are tube-shaped, inflatable, and at least as long as the width of the backing cloth (3) and the fabric (4), and the gaskets (19, 20) are housed within respective tube-shaped containers (17, 18).

6. An apparatus according to claim 1, further comprising two side struts (27) located a predetermined distance apart, said two, side struts (27) supporting said cylinder (5), said cylinder (5) being shorter than the distance between said side struts (27), and the seals (25, 26; 25', 26') being provided between each of the side struts (27) and the ends of said cylinder.

7. The apparatus of claim 6 wherein said seals on each end of the cylinder (5) comprise a resilient material disc (25, 25') which contacts the respective side strut (27, 27'), and a thinner disc (26, 26') of an antifriction material located between the respective end of the cylinder (5) and the resilient disc (25, 25').

8. An apparatus according to claim 1, further comprising, a thin plate (14) located in a second area between the second guide roller (10) and the cylinder (5), on a side of the backing cloth (3) and the decatized fabric (4) subjected to the action of steam, the thin plate (14) being at least as wide as the backing cloth and the decatized fabric and having a length adapted to cover as much as possible of a surface of the backing cloth and the decatized fabric exiting from around the foraminous cylinder (2), said thin plate being moveable, such that it can be moved away from said surface by means of external controls.

* * * * *